United States Patent [19]

Calabrese

[11] 4,303,188

[45] Dec. 1, 1981

[54] DRYWALL AND PLASTERING KNIFE CADDY

[76] Inventor: Michael A. Calabrese, 37237 Allen Ave., Cathedral City, Calif. 92234

[21] Appl. No.: 177,106

[22] Filed: Aug. 11, 1980

[51] Int. Cl.[3] ..... A45C 11/00

[52] U.S. Cl. ..... 224/253; 206/372; 224/904

[58] Field of Search ..... 224/232–234, 224/252, 253, 904, 920; 206/372, 523, 591, 592; 30/151, 162; 211/60 T

[56] References Cited

U.S. PATENT DOCUMENTS

| | | | |
|---|---|---|---|
| 1,661,121 | 2/1928 | Huson | 206/372 |
| 1,708,612 | 4/1929 | Gilbert | 224/232 |
| 1,901,583 | 3/1933 | Conway | 211/60 T |
| 2,183,074 | 12/1939 | Hopkins | 206/372 |
| 2,580,913 | 1/1952 | Hawthorne | 224/920 |
| 3,870,148 | 3/1975 | Hite | 206/372 |

FOREIGN PATENT DOCUMENTS

| | | | |
|---|---|---|---|
| 1035474 | 8/1953 | France | 206/372 |
| 129910 | 10/1950 | Switzerland | 206/372 |
| 5720 | of 1907 | United Kingdom | 224/253 |

*Primary Examiner*—Stephen Marcus
*Attorney, Agent, or Firm*—Harold C. Horwitz

[57] ABSTRACT

There is disclosed a knife caddy and more particularly a caddy for carrying one or a plurality of various size drywall or plastering knives. The caddy is comprised of two sections, the smaller one of which may be disengaged from the larger section for portable use and can be carried on the worker's belt with several knives contained therein.

1 Claim, 5 Drawing Figures

FIG. 2
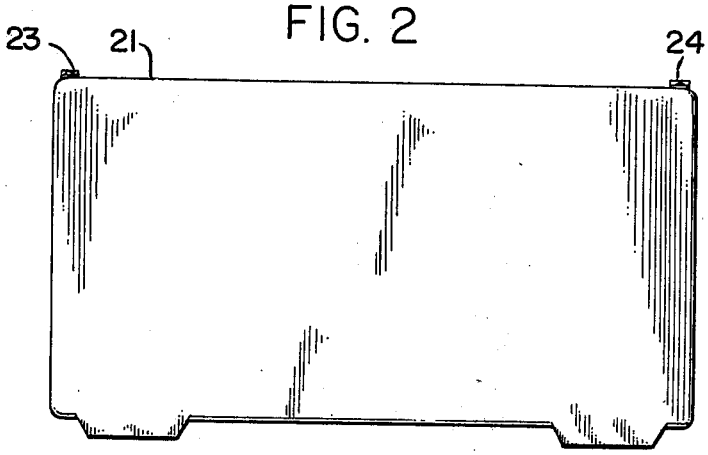
FIG. 3
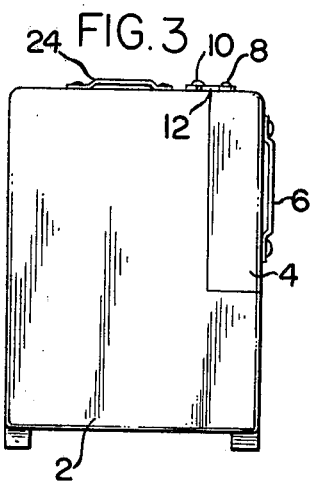
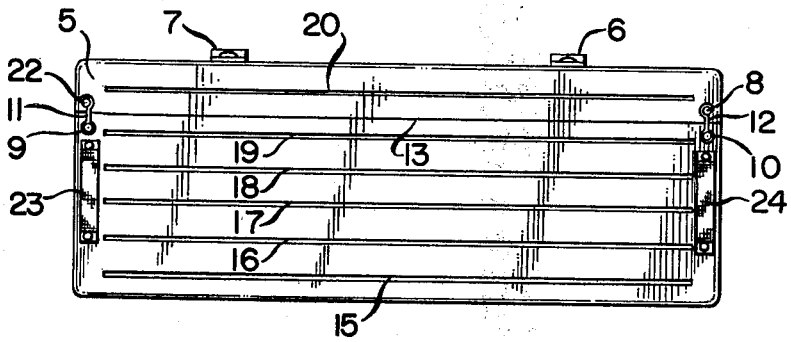
FIG. 4
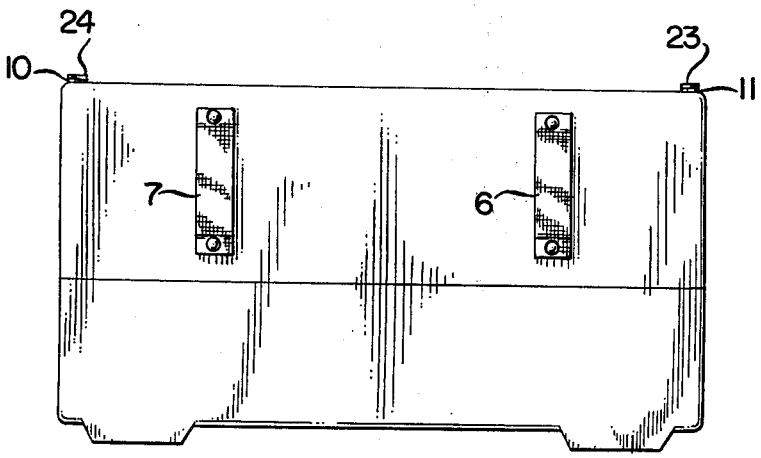
FIG. 5

DRYWALL AND PLASTERING KNIFE CADDY

BACKGROUND OF THE INVENTION

1. Field of the Invention

This invention relates to knife caddys and more particularly to a drywall and plastering knife caddy of two sections, the smaller section capable of portable use, being carried on a worker's belt.

2. Description of the Prior Art

Drywall and plastering knives are commonly manufactured in sizes ranging from one inch to fourteen inches and are commonly carried in trays or simply in the trunk or bed of the worker's truck, there being no known caddy type device designed to carry the knives en mass or on a worker's belt. Heretofore a drywall hanger or plasterer would carry one or two knives to the job site and when a different sized knife would be required he would usually shuffle through an assortment of knives contained in a tray, for instance.

An important object of this invention is to provide a caddy which will carry a large selection of various size drywall and plastering knives which will fully protect the knives from damaging each other and which also will protect the person from being injured by the knives being carried.

Another important object of this invention is to provide a caddy having a removable section capable of being carried on a worker's belt.

SUMMARY OF THE INVENTION

A novel drywall and plastering knife caddy has been developed. The caddy, comprised of two sections, will carry one or a plurality of knives. The caddy is comprised of front, back, side and top walls, the top wall having a plurality of parallel slots therethrough, extending from one side of the top wall to the opposite side of the top wall. The slots are dimensioned to provide a friction engagement with the knives carried therein.

A small section of the caddy, bearing one or more slots may be disengaged therefrom and can be carried on a worker's belt.

BRIEF DESCRIPTION OF THE DRAWINGS

The caddy will be described by the illustrations of the presently preferred embodiment, of which:

FIG. 2 is a rear view of the caddy;

FIG. 3 is a side view of the caddy;

FIG. 4 is a top view of the caddy; and

FIG. 5 is a front view of the caddy.

DESCRIPTION OF PREFERRED EMBODIMENTS

Figure 1:
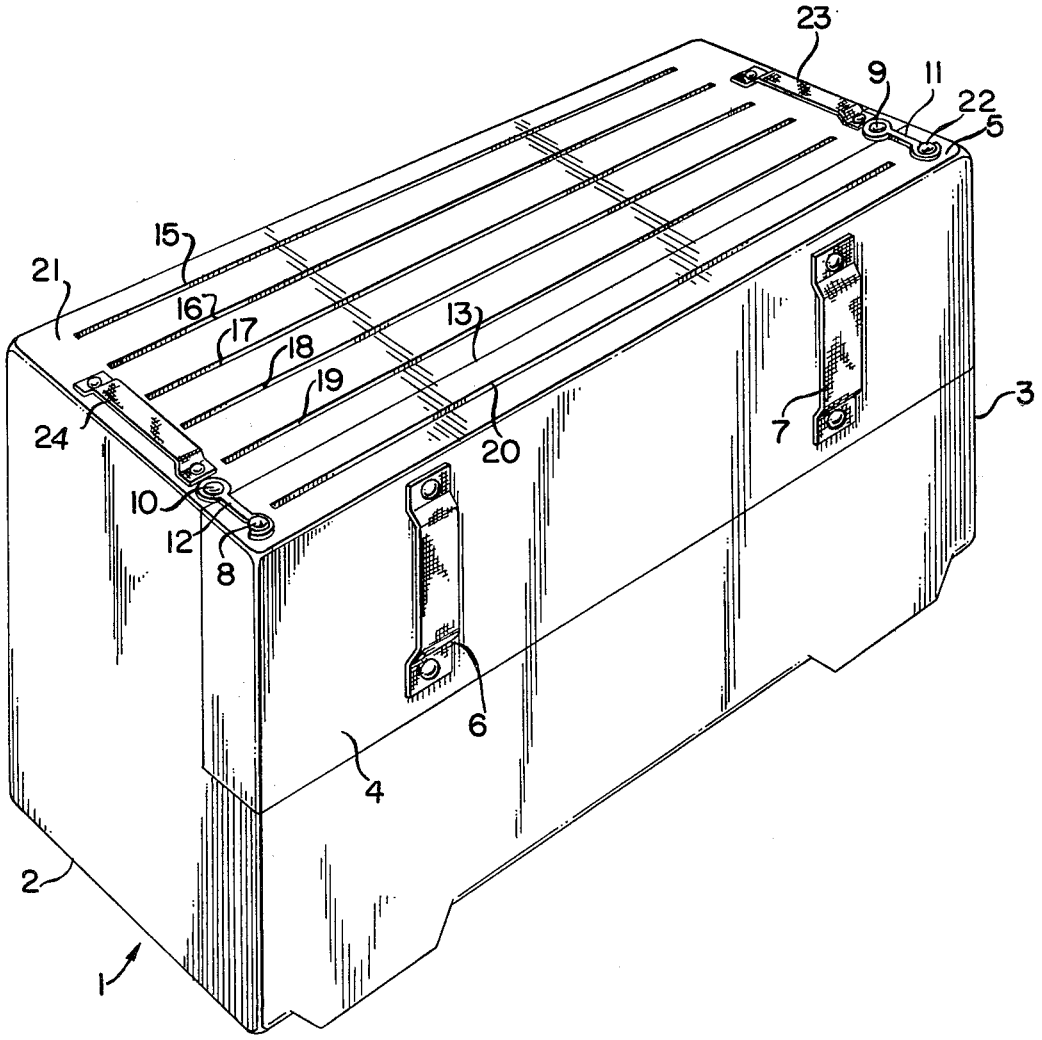
FIG. 1 is a perspective view of the caddy.

A preferred embodiment of the caddy 1, a perspective view of which is shown in FIG. 1, includes a plurality of slots 15 through 20 dimensioned to accommodate, by friction fit, various size drywall an plastering knives which may be inserted into the slots. The interface of the larger caddy section 21 and the removable caddy section 4 is shown at 13.

Fastening means 11, 12 secure the caddy sections together by rotating fastening means about pivot means 9, 10 so as to form tight engagement with catches 8, 22.

The caddy has connecting means 24, 23 which may be made of leather loops for instance and which may be used to connect a leather strap, or other carrying means not shown, thereto. The leather loops or other carrying means are fixedly secured to a wall member of the caddy in any conventional way.

Once the drywall or plaster site has been reached with the large selection of tools carried in the caddy, the worker may wish to carry one of more tools on his person and for that purpose will disengage the caddy sections, placing carrying means 6, 7 on his belt.

The caddy may be made of plastic, metal or other suitable material and when carried on the belt of a worker, side wall 4 will protect him from being injured by tool blade.

What is claimed is:

1. A drywall and plastering knife caddy having a detachable section which comprises:

carrying means, side walls, a top wall and a detachable section;

said top wall being provided with a plurality of parallel slots dimensioned to frictionally engage the knife blades and bearing means to secure the detachable section to the caddy; and said detachable section carrying belt receiving loops.

* * * * *